US008249283B2

(12) United States Patent
Ando et al.

(10) Patent No.: US 8,249,283 B2
(45) Date of Patent: Aug. 21, 2012

(54) THREE-DIMENSIONAL ACOUSTIC PANNING DEVICE

(75) Inventors: Akio Ando, Tokyo-to (JP); Mikihiko Okamoto, Tokyo-to (JP); Kimio Hamasaki, Tokyo-to (JP)

(73) Assignees: Nippon Hoso Kyokai, Tokyo (JP); Fairlight Japan, Inc., Tokyo (JP); Fairlight AU Pty Ltd., Frenchs Forest (AU)

( * ) Notice: Subject to any disclaimer, the term of this patent is extended or adjusted under 35 U.S.C. 154(b) by 1067 days.

(21) Appl. No.: 12/160,995

(22) PCT Filed: Jan. 19, 2007

(86) PCT No.: PCT/JP2007/050781

§ 371 (c)(1),
(2), (4) Date: Jul. 15, 2008

(87) PCT Pub. No.: WO2007/083739

PCT Pub. Date: Jul. 26, 2007

(65) Prior Publication Data

US 2010/0157726 A1 Jun. 24, 2010

(30) Foreign Application Priority Data

Jan. 19, 2006 (JP) ..... 2006-010943
Jun. 8, 2006 (JP) ..... 2006-159925

(51) Int. Cl.
*H04R 5/02* (2006.01)
*H04R 5/00* (2006.01)

(52) U.S. Cl. ..... 381/306; 381/300; 381/303; 381/17

(58) Field of Classification Search ..... 381/306, 381/300, 307, 303, 304, 17, 18, 98
See application file for complete search history.

(56) References Cited

U.S. PATENT DOCUMENTS 5,404,406 A * 4/1995 Fuchigami et al. ..... 381/17
(Continued)

FOREIGN PATENT DOCUMENTS

JP 05-303382 11/1993
(Continued)

OTHER PUBLICATIONS

Ville Pulkki; "Localization of Amplitude-Panned Virtual Sources II: Two-and three-Dimensional Panning"; J. Audio Eng. Soc., vol. 49, No. 9; Sep. 2001; pp. 753-767.

(Continued)

*Primary Examiner* — Edgardo San Martin
(74) *Attorney, Agent, or Firm* — Greer, Burns & Crain, Ltd.

(57) ABSTRACT

[Problems]
To provide a three-dimensional acoustic panning device enabling a three-dimensional-panning of a sound source as a sound image panning.
[Means for Solving the Problems]
The three-dimensional acoustic panning device 1 includes a sound source acoustic signal acquiring means 11 for acquiring a sound source acoustic signal s(t) radiated from at least one sound source C, a panning information input means 12 for inputting an panning information $I_p$ to pan the sound source C, an sound image forming acoustic signal output means 13 for outputting sound image forming acoustic signals q(t) to form at least one sound image at the position where the sound source C is positioned, an arrangement information storage means 14 for storing an arrangement information $I_s$ of the sound image forming acoustic signal output means 13, and a sound image forming acoustic signal generating means 15 for generating sound image forming acoustic signals q(t) using the sound source acoustic signals s(t), the panning information $I_p$ and the arrangement information $I_s$.

8 Claims, 9 Drawing Sheets

U.S. PATENT DOCUMENTS

| | | | | |
|---|---|---|---|---|
| 5,459,790 | A * | 10/1995 | Scofield et al. | 381/310 |
| 5,598,478 | A * | 1/1997 | Tanaka et al. | 381/17 |
| 5,696,831 | A | 12/1997 | Inanaga et al. | |
| 5,822,438 | A * | 10/1998 | Sekine et al. | 381/17 |
| 6,243,476 | B1 * | 6/2001 | Gardner | 381/303 |
| 7,027,600 | B1 * | 4/2006 | Kaji et al. | 381/17 |
| 7,970,144 | B1 * | 6/2011 | Avendano et al. | 381/1 |
| 2002/0048380 | A1 | 4/2002 | McGrath | |
| 2003/0086580 | A1 | 5/2003 | Hamamatsu | |
| 2003/0091204 | A1 * | 5/2003 | Gibson | 381/119 |
| 2006/0045295 | A1 * | 3/2006 | Kim | 381/310 |
| 2006/0067541 | A1 * | 3/2006 | Yamada et al. | 381/98 |
| 2008/0232616 | A1 * | 9/2008 | Pulkki et al. | 381/300 |
| 2008/0232617 | A1 * | 9/2008 | Goodwin et al. | 381/307 |
| 2008/0253577 | A1 * | 10/2008 | Eppolito | 381/17 |
| 2008/0253592 | A1 * | 10/2008 | Sanders et al. | 381/306 |
| 2009/0046864 | A1 * | 2/2009 | Mahabub et al. | 381/17 |
| 2009/0144063 | A1 * | 6/2009 | Beack et al. | 704/500 |
| 2009/0147975 | A1 * | 6/2009 | Horbach et al. | 381/307 |
| 2010/0111336 | A1 * | 5/2010 | Jeong et al. | 381/306 |
| 2010/0260342 | A1 * | 10/2010 | Strub | 381/1 |
| 2011/0013790 | A1 * | 1/2011 | Hilpert et al. | 381/300 |
| 2011/0116638 | A1 * | 5/2011 | Son et al. | 381/1 |
| 2011/0222694 | A1 * | 9/2011 | Del Galdo et al. | 381/17 |

FOREIGN PATENT DOCUMENTS

| | | | |
|---|---|---|---|
| JP | 06-301390 | | 10/1994 |
| JP | A 8-9490 | | 1/1996 |
| JP | A 8-205298 | | 8/1996 |
| JP | 11262097 | A * | 9/1999 |
| JP | 2002159097 | A * | 5/2002 |
| JP | A 2002-159097 | | 5/2002 |
| JP | A 2002-165300 | | 6/2002 |
| JP | A 2003-134600 | | 5/2003 |
| JP | A 2005-249989 | | 9/2005 |

OTHER PUBLICATIONS

Ville Pulkki; "Virtual Sound Source Positioning Using Vector Base Amplitude Panning"; J. Audio eng. Soc., vol. 45, No. 6; Jun. 1997; pp. 456-466.

* cited by examiner

THREE-DIMENSIONAL ACOUSTIC PANNING DEVICE

This application is a U.S. National Phase under 35 U.S.C. §371, of International Application No. PCT/JP2007/050781, filed Jan. 19, 2007.

TECHNICAL FIELD

The present invention relates to a three-dimensional acoustic panning device, especially, relates to a three-dimensional acoustic panning device enabling a three-dimensional-panning of a sound source by a three-dimensional panning of a sound image formed by a plurality of acoustic signals from a plurality of loudspeakers regardless of arrangement of loudspeakers.

BACKGROUND OF THE INVENTION

It is possible for a conventional audio reproduction device such as two-channel audio system, 5.1 channel audio system, etc, to move a sound image horizontally, but difficult to move it vertically and/or anteroposteriorly, because the system moves a sound image by changing each of amplitudes of acoustic waves from a plurality of loudspeakers arranged on the circle centering on a sound receiving point with an operation of a pan-pod on a mixing console.

Then, a device enabling to move a sound image three-dimensionally, that is, not only horizontally, but also vertically and/or anteroposteriorly has already been proposed. (See Patent Publication 1, Patent Publication 2 and Non-Patent Publication 1)

The device equipping FIR filters disclosed in Patent Publication 1 makes it possible to move a sound image not only horizontally but also vertically by using two loudspeakers arranged on the same horizontal plane.

The device disclosed in Patent Publication 2 makes it possible to move a sound image not only horizontally but also vertically by selecting loudspeakers generating an acoustic wave and controlling amplitude of the acoustic wave in accordance with the position (angle and distance) between a listener and the sound source.

Further, the device disclosed in Non-Patent Publication 1 makes it possible to form a sound image at the same position as a sound source by outputting acoustic waves whose amplitudes are determined based on the lengths of three vectors into which a position vector of the sound source from a sound receiving point is broken.

A panning device which makes it possible to pan a sound image when a plurality of loudspeakers are arranged along edges of a rectangular filed such as a theater has already been proposed. (See, Patent Publication 3 and Non-Patent Publication 2)

The device disclosed in Patent Publication 3 makes it possible to move a sound image by delaying an acoustic wave generated from one loudspeaker to another acoustic wave generated from another loudspeaker when a plurality of loudspeakers are arranged along edges of a rectangular filed such as the theater Further, the device disclosed in Non-Patent Publication 2 moves a sound image three-dimensionally by applying a vector base amplitude panning method to a plurality of loudspeakers arranged three-dimensionally.

Patent Publication 1: Japanese Patent Publication No. 3177714 (See [001], FIG. 1)

Patent Publication 2: Japanese Unexamined Patent Publication (Kokai) No. H06-301390 (See [0010]-[0015], FIG. 1)

Patent Publication 3:U.S. unexamined Patent Publication No. 20020048380 (See [0026], FIG. 3)

Non-Patent Publication 1: "Localization of Amplitude-Panned Virtual Sources II: Two- and Three-Dimensional Panning" VILLE PULKKI, J. Audio Eng. Soc. Vol. 49, No. 9, 2001 September Non-Patent Publication 1: "Virtual Sound Source Positioning Using Vector Base Amplitude Panning" VILLE PULKKI, J. Audio Eng. Soc. Vol. 45, No. 6, 1997 June

DISCLOSURE OF THE INVENTION

The Problem to be Solved

The device disclosed in Patent Publication 1, however, has a problem that an anteroposterior panning is difficult. The device disclosed in Patent Publication 2 and Non Patent Publication have a problem that a precise anteroposterior panning is difficult, because the system moves a sound image anteroposteriorly based on the amplitude of the acoustic wave, not based on the phase of the acoustic wave.

The device disclosed in Patent Publication 3 and Non Patent Publication 2 have a problem that a service area is narrowed at a rectangular acoustic field such as a theater, because it requires arranging a plurality of loudspeakers along a spherical surface centering on a sound receiving point, that is, positions of audience's ears The present invention to dissolve the above problems, therefore, aims to provide a three-dimensional acoustic panning device enabling a three-dimensional-panning of a sound source by a three-dimensional panning of a sound image formed by a plurality of acoustic signals from a plurality of loudspeakers regardless of arrangement of loudspeakers

Means to Solve the Problem

A three-dimensional acoustic panning device according to the first invention comprises a sound source acoustic signal acquiring means for acquiring a sound source acoustic signal radiated from at least one sound source, a panning information input means for inputting an panning information to pan said sound source, a sound image forming acoustic signal output means for outputting sound image forming acoustic signals to form at least one sound image at the position where said sound source is positioned, an arrangement information storage means for storing an arrangement information of said sound image forming acoustic signal output means, and a sound image forming acoustic signal generating means for generating sound image forming acoustic signals using said sound source acoustic signals, said panning information and said arrangement information.

According to the above constitution, it becomes possible to simulate a three-dimensional panning of the sound sources by panning sound images formed by sound image forming acoustic signals output from a plurality of loudspeakers.

A three-dimensional acoustic panning device according to the second invention provides said panning information input means comprising a directional information input means for inputting at least one set of directional information concerning the direction of said sound sources viewed from a sound receiving point and a distance information input means for inputting at least one set of distance information concerning the distance between said sound receiving point and said sound sources.

According to the above constitution, it becomes possible to set said panning information as directional information and distance information.

A three-dimensional acoustic panning device according to the third invention provides said panning information input means having a panning information storage means for storing said panning information.

According to the above constitution, it becomes possible to store panning information.

A three-dimensional acoustic panning device according to the fourth invention provides said sound image forming acoustic signal output means having a recording/editing means for recording and editing said sound image forming acoustic signal.

According to the above constitution, it becomes possible to record and edit said sound image forming acoustic signal.

A three-dimensional acoustic panning device according to the fifth invention provides said sound image forming acoustic signal generating means comprising a transforming means for Fourier transforming said sound source acoustic signal to a frequency region sound source acoustic signal, a frequency region sound image forming acoustic signal generating means for generating a frequency region sound image forming acoustic signal using said frequency region sound source acoustic signal, said panning information, and said arrangement information, and an inverse transforming means for inverse Fourier transforming said frequency region sound image forming acoustic signal to said sound image forming acoustic signal which is a time region signal.

According to the above constitution, it becomes possible to generate sound image forming acoustic signals using the sound source acoustic signal, the panning information and the arrangement information.

A three-dimensional acoustic panning device according to the sixth invention provides said frequency region sound image forming acoustic signal generating means generates said sound image forming acoustic signal which forms a sound image acoustic physical quantity vector at the sound receiving point equal to the sound source acoustic physical quantity vector which is an acoustic physical quantity vector at the sound receiving point formed by panning the sound sources, which radiate the sound source acoustic signals, based on the panning information.

According to the above constitution, it becomes possible to pan the sound image three-dimensionally regardless the arrangement of loudspeakers.

A three-dimensional acoustic panning device according to the seventh invention provides said frequency region sound image forming acoustic signal generating means generates said sound image forming acoustic signal which forms a sound image acoustic physical quantity vector at the sound signal receiving area equal to a sound source acoustic physical quantity vector which is an acoustic physical quantity vector at the sound signal receiving area formed by panning the sound sources which radiate the sound source acoustic signals based on the panning information.

According to the above constitution, it becomes possible to position the sound images for a plurality of audiences.

A three-dimensional acoustic panning device according to the eighth invention provides a mixing means for mixing the sound source acoustic signals acquired by said sound source acoustic signal acquiring means.

According to the above constitution, it becomes possible not only to pan the sound source acoustic signals, but also to mix them.

Effect of the Invention

The present invention can provide a three-dimensional acoustic panning device enabling a three-dimensional-panning of a sound source by a three-dimensional panning of a sound image formed by a plurality of acoustic signals output from a plurality of loudspeakers regardless of arrangement of loudspeakers.

PREFERRED EMBODIMENT FOR CARRYING OUT THE INVENTION

Hereinafter, preferred embodiments of a three-dimensional acoustic panning device according to the present invention will be concretely described with referent to the drawings.

In the present description, an acoustic physical quantity vector is defined as an acoustic physical quantity at a sound receiving point where an acoustic signal radiated from a point sound source is received, that is, a vector consisting of at least one of acoustic pressure and acoustic particle velocity, or acoustic intensity vector equal to the value of integral between a predetermined period of the product of the acoustic particle velocity and the acoustic pressure of a scalar.

The First Embodiment

As shown in the block diagram of FIG. 1, the first embodiment of a three-dimensional acoustic panning device 1 comprises a sound source acoustic signal acquiring means 11 for acquiring a sound source acoustic signal s(t) radiated from at least one sound source C, a panning information input means 12 for inputting an panning information $I_p$ to pan the sound source C, an sound image forming acoustic signal output means 13 for outputting sound image forming acoustic signals q(t) to form at least one sound image at the position where the sound source C is positioned, an arrangement information storage means 14 for storing an arrangement information $I_s$ of the sound image forming acoustic signal output means 13, and a sound image forming acoustic signal generating means 15 for generating sound image forming acoustic signals q(t) using the sound source acoustic signals s(t), the panning information $I_p$ and the arrangement information $I_s$.

And, the panning information input means 12 may include a directional information input means 121 for inputting at least one set of directional information $I_{pd}$ concerning the direction of the sound sources C viewed from the sound receiving point G and a distance information input means 122 for inputting at least one set of distance information $I_{pr}$ concerning the distance between the sound receiving point G and the sound source C.

The panning information input means 12 may include a panning information storage means 123 for storing the panning information $I_p$.

The sound image forming acoustic signal output means 13 may include a recording/editing means 131 for recording and editing the sound image forming acoustic signal q(t).

The sound image forming acoustic signal generating means 15 comprises a transforming means 151 for Fourier transforming the sound source acoustic signal s(t) to a frequency region sound source acoustic signal S(ω), a frequency region sound image forming acoustic signal generating means 152 for generating a frequency region sound image forming acoustic signal Q(ω) using the frequency region sound source acoustic signal S(ω), the panning information $I_p$ and the arrangement information $I_s$, and an inverse transforming means 153 for inverse Fourier transforming the frequency domain sound image forming acoustic signal Q(ω) to the time region sound image forming acoustic signal q(t).

FIG. 2 is a block diagram showing a hardware configuration of the three-dimensional acoustic panning device according to the invention, and the device is comprised of a bus 20, an analog-digital (A/D) converter 21 for acquiring a sound source acoustic signal s(t) from the sound source, a digital-analog (D/A) converter 22 for outputting a sound image forming acoustic signal q(t), a CPU 23 for executing a three-dimensional acoustic panning program, a memory to store the three-dimensional acoustic panning program, and an interface (I/F) connected with peripheral devices for operating the three-dimensional acoustic panning device.

I/F 25 is connected to a display panel 261, a key-board 262, a mouse 263, a track ball 27 for inputting a directional information $I_{pd}$ of the panning information $I_p$ and a pan pod for inputting a distance information $I_{pr}$ of the panning information $I_p$. Note, a special operating panel may be applied instead of a display panel 261, a key-board 262 and a mouse 263.

That is, the three-dimensional acoustic panning device according to the invention is configured by installing the three-dimensional panning program to the computer 2.

FIG. 3 is a perspective view of track ball 27(*a*), and pan pod 28(*b*).

Track ball 27 has a structure that ball 272 is inserted in a recess well formed on track ball base 271, and ball 272 can be rolled to any directions.

The directional information of the sound source C centering on the sound receiving point G (rotational direction and rotational amount of the sound source) may be set by rotating ball 272 with a finger or a palm.

Pan pod 28 is a variable resister, for example, and distance information between the sound receiving point G and the sound source C may be set by sliding finger grip 282 on pan pod base 281.

FIG. 4 is a flowchart of the three-dimensional panning program to be installed in memory 24. At first, CPU 23 fetches the sound source acoustic signal s(t) from the sound source through A/D converter 21 (STEP S41).

The sound source acoustic signal s(t) from the sound source may be an acoustic signal stored in a storage device such as a hard-disc, or may be a live acoustic signal acquiring by microphones.

CPU 23 calculates the frequency region sound source acoustic signal S(ω) by Fourier transforming the sound source acoustic signal s(t) (STEP S42).

CPU 23 calculates the frequency region sound image forming acoustic signal Q(ω) by performing a panning process (STEP S43), and calculates a time domain sound image forming acoustic signal q(t) by inverse Fourier transforming the frequency domain sound image forming acoustic signal Q(ω) (STEP S44).

The process of STEP S43 will be explained in detail hereafter.

Finally, CPU 23 terminates this program after outputting the sound image forming acoustic signal q(t) through D/A converter 22 (STEP S45).

At STEP S43 of the three-dimensional acoustic panning program, CPU 23 generates the sound image forming acoustic signal q(t) which forms the sound image acoustic physical quantity vector V equal to the sound source acoustic physical quantity vector R, that is, an acoustic physical quantity vector formed at the sound receiving point G by panning the sound source C which radiates the sound source acoustic signal s(t) according to the panning information $I_p$.

At first, an acoustic physical quantity vector at the sound receiving point will be explained, when one point sound source and one sound receiving point are assumed.

The acoustic pressure p(t, r) of an acoustic wave radiated from the point sound source positioned at the origin of a three-dimensional space on the spherical surface with r in radius is determined by the wave equation [EQ. 1].

$$\frac{\partial^2}{\partial t^2}(rp) = c^2 \frac{\partial^2}{\partial r^2}(rp) \quad \text{[EQ. 1]}$$

Where $$c^2 = \frac{K}{\rho}$$

$K$ = bulk modulus of air $\rho$ = density of air

Therefore, the acoustic pressure p(t, r) of an acoustic wave on the spherical surface with r in radius is denoted by [EQ. 2], when the sound source acoustic signal radiated from the point sound source is s(t).

$$p(t, r) = \frac{A}{r} s\left(t - \frac{r}{c}\right) \quad \text{[EQ. 2]}$$

Where•A=proportional constant determined by the amplitude of input signal and the acoustic pressure at the unit distance

[EQ. 2] shows that when a sound source acoustic signal s(t) radiated from a point sound source is received at one sound receiving point, an acoustic pressure at the sound receiving point decreases in inverse proportion to the distance between the point sound source and the sound receiving point, and has a delay of the propagation time from the point sound source to the sound receiving point.

[EQ. 2] is denoted as [EQ. 3] in the frequency region.

$$P(\omega, r) = \frac{A \cdot e^{-jkr}}{r} S(\omega) = G_p(\omega, r) \cdot S(\omega) \quad \text{[EQ. 3]}$$

Where $$j = \sqrt{-1}$$

$k = \frac{\omega}{c}$ = wave number (wavelength constant)

$\omega$ = angular frequency $e$ = base of natural logarithm $G_p(\omega, r)$ = acoustic pressure transfer function $S(\omega)$ = frequency region sound *sorce* acoustic signal

[EQ. 3] shows that the acoustic pressure at the sound receiving point is calculated by inverse Fourier conversion of a product of the acoustic pressure transfer function $G_p(\omega, r)$ which is a function of a distance between the point sound source and the sound receiving point and a frequency region sound source acoustic signal S(ω).

Because the distance between the point sound source and the sound receiving point, and the propagation time of the sound source acoustic signal is unambiguously determined when the coordinate values of the point sound source and the sound receiving point are determined in any coordinate systems, the acoustic pressure transfer function will be unambiguously determined when the coordinate values of the point sound source and the sound receiving point are determined.

When particle velocity of the sound source acoustic signal radiated from the point sound source positioned at the origin of the three-dimensional space is denoted by $v(r, t)\cdot e_r$, (where $e_r$, is a unit vector of r-direction) the motion equation on the spherical surface with r in radius is denoted by [EQ. 4]

$$\rho\frac{\partial v(r,t)}{\partial t} = -\frac{\partial p(t,r)}{\partial r} = -\frac{\partial}{\partial r}\left\{\frac{1}{r}s\left(t-\frac{r}{c}\right)\right\} \quad \text{[EQ. 4]}$$

The particle velocity v(r) is denoted as [EQ. 5] by solving [EQ. 4].

$$v(r,t) = \frac{B}{\rho cr}s\left(t-\frac{r}{c}\right) + \frac{B}{\rho r^2}\int s\left(t-\frac{r}{c}\right)dt\left(t-\frac{r}{c}\right) \quad \text{[EQ. 5]}$$

Where B=proportional constant determined by the amplitude of the input signal and the acoustic pressure at the unit distance

[EQ. 5] is denoted as [EQ. 6] in the frequency region.

$$\begin{aligned} V(\omega,r) &= \frac{B\cdot e^{-jkr}}{\rho cr}S(\omega) + \frac{B\cdot e^{-jkr}}{j\omega\rho r^2}S(\omega) \\ &= \frac{B\cdot e^{-jkr}}{\rho cr}\left(1+\frac{1}{jkr}\right)S(\omega) \\ &= G_v(\omega,r)\cdot S(\omega) \end{aligned} \quad \text{[EQ. 6]}$$

Where $G_v(\omega,r)$=particle velocity transfer function

Therefore, the acoustic physical quantity vector $P_k$ consisting of the acoustic pressure p(t, r) and the particle velocity vector $v(t, r)\cdot e_r$ at the sound receiving point k is defined by [EQ. 7].

$$P_k = \begin{bmatrix} P(\omega,r) \\ V_x(\omega,r) \\ V_y(\omega,r) \\ V_z(\omega,r) \end{bmatrix} = \begin{bmatrix} G_p(\omega,r) \\ G_{vx}(\omega,r) \\ G_{vy}(\omega,r) \\ G_{vz}(\omega,r) \end{bmatrix} S(\omega) \quad \text{[EQ. 7]}$$

Where, when $e_x$, $e_y$ and $e_z$ denote x, y and z components of n unit vector $e_r$ respectively, the following equations are established.

$$V_x(\omega,r)=V(\omega,r)\cdot e_x,\ V_y(\omega,r)=V(\omega,r)\cdot e_y,\ V_z(\omega,r)=V(\omega,r)\cdot e_z$$

$$G_{vx}(\omega,r)=G_v(\omega,r)\cdot e_x,\ G_{vy}(\omega,r)=G_v(\omega,r)\cdot e_y,\ G_{vz}(\omega,r)=G_v(\omega,r)\cdot e_z$$

The acoustic physical quantity vector $P_k$ may consist of one of the acoustic pressure p(t, r) and the particle velocity vector $v(t, r)\cdot e_r$.

Moreover, the acoustic physical quantity vector $P_k$ may consist of an instant acoustic intensity II(t, r) which is a product of the acoustic pressure p(t, r) and the particle velocity vector $v(t, r)\cdot e_r$, or an acoustic intensity I(t, r) which is an integration value of the instant acoustic intensity II(t, r) over some time interval.

Note, the instant acoustic intensity II(t, r) is defined by [EQ. 8] and the acoustic intensity I(t, r) is defined by [EQ. 9].

$$II(t,r) = p(t,r)\cdot v(t,r)\cdot e_r \quad \text{[EQ. 8]}$$

$$I(t,r) = \int_{t_1}^{t_2} II(t,r)\,dt = \int_{t_1}^{t_2} p(t,r)\cdot v(t,r)\cdot e_r\,dt \quad \text{[EQ. 9]}$$

The following embodiments use the acoustic pressure as the acoustic physical quantity vector.

The coordinates of a sound source positioned in the space having the origin at the sound receiving point G is denoted as $C(r_c(\tau), \theta_c(\tau), \phi_c(\tau))$, and then the sound source acoustic pressure vector R is defined by [EQ. 10].

$$R = \begin{bmatrix} R_x \\ R_y \\ R_z \end{bmatrix} = -\begin{bmatrix} \frac{e^{-jkr_c(\tau)}}{r_c(\tau)}\cos\phi_c(\tau)\cos\theta_c(\tau) \\ \frac{e^{-jkr_c(\tau)}}{r_c(\tau)}\cos\phi_c(\tau)\sin\theta_c(\tau) \\ \frac{e^{-jkr_c(\tau)}}{r_c(\tau)}\sin\phi_c(\tau) \end{bmatrix} S(\omega) \quad \text{[EQ. 10]}$$

Where $\theta_c(\tau)$=azimuth of the sound source $\phi_c(\tau)$=elevation angle of the sound source $r_c(\tau)$=the distance between the sound source and the sound receiving point $\tau$=time code concerning panning of the sound source If a loudspeaker $SP_i$ (i=1, 2 . . . I) working as the sound image forming acoustic signal output means 13 is positioned at $SP_i(r_i, \theta_i, \phi_i)$, a sound image acoustic pressure vector V which is an acoustic pressure at the origin when the loudspeakers SP; radiate frequency region sound image forming acoustic signals $Q_i(\omega)$ (i=1, 2 . . . I) is defined by [EQ. 11].

$$V = A\cdot\begin{bmatrix} \sum_{i=1}^{I}\frac{e^{-jkr_i}}{r_i}\cos\phi_i\cos\theta_i Q_i(\omega) \\ \sum_{i=1}^{I}\frac{e^{-jkr_i}}{r_i}\cos\phi_i\sin\theta_i Q_i(\omega) \\ \sum_{i=1}^{I}\frac{e^{-jkr_i}}{r_i}\sin\phi_i Q_i(\omega) \end{bmatrix} \quad \text{[EQ. 11]}$$

Where $\theta_i$=azimuth of the loudspeaker S $P_i$ $\phi_i$=elevation angle of the loudspeaker S $P_i$ $r_i$=distance between the origin and the loudspeaker S $P_i$ If $Q_1(\omega), Q_2(\omega) \ldots Q_I(\omega)$ are determined so that [EQ. 12] is established, and are output from the loudspeaker after inverse transferring into the time domain, it is realized to reproduce the satiation where the sound source acoustic signal s(t) is being panned by radiating the sound image forming acoustic signal q(t) from the laud speakers positioned at the predetermined positions.

$$R=V \quad \text{[EQ. 12]}$$

To determine the sound image forming acoustic signals $q_1(t), q_2(t) \ldots q_I(t)$ so that [EQ. 12] is established, these signals are determined so that the square error E between the sound source acoustic pressure vector R and the sound image acoustic pressure vector V denoted by [EQ. 13] becomes minimum.

$$E=\|R-V\|^2 \quad \text{[EQ. 13]}$$

[EQ. 13] is developed to [EQ. 14] by assigning [EQ. 10] and [EQ. 11] to [EQ. 13].

[EQ. 14]

$$\begin{aligned}E = {} & \left[\frac{e^{-jkr_c(\tau)}}{r_c(\tau)}\cos\phi_c(\tau)\cos\theta_c(\tau)S(\omega) - \sum_{i=1}^{I}\frac{e^{-jkr_i}}{r_i}\cos\phi_i\cos\theta_i Q_i(\omega)\right]\times \\ & \left[\frac{e^{-jkr_c(\tau)}}{r_c(\tau)}\cos\phi_c(\tau)\cos\theta_c(\tau)S(\omega) - \sum_{i=1}^{I}\frac{e^{-jkr_i}}{r_i}\cos\phi_i\cos\theta_i Q_i(\omega)\right]^* + \\ & \left[\frac{e^{-jkr_c(\tau)}}{r_c(\tau)}\cos\phi_c(\tau)\sin\theta_c(\tau)S(\omega) - \sum_{i=1}^{I}\frac{e^{-jkr_i}}{r_i}\cos\phi_i\sin\theta_i Q_i(\omega)\right]\times \\ & \left[\frac{e^{-jkr_c(\tau)}}{r_c(\tau)}\cos\phi_c(\tau)\sin\theta_c(\tau)S(\omega) - \sum_{i=1}^{I}\frac{e^{-jkr_i}}{r_i}\cos\phi_i\sin\theta_i Q_i(\omega)\right]^* + \\ & \left[\frac{e^{-jkr_c(\tau)}}{r_c(\tau)}\sin\phi_c(\tau)S(\omega) - \sum_{i=1}^{I}\frac{e^{-jkr_i}}{r_i}\sin\phi_i Q_i(\omega)\right]\times \\ & \left[\frac{e^{-jkr_c(\tau)}}{r_c(\tau)}\sin\phi_c(\tau)S(\omega) - \sum_{i=1}^{I}\frac{e^{-jkr_i}}{r_i}\sin\phi_i Q_i(\omega)\right]^*\end{aligned}$$

Where [X]* denotes the conjugate of [X]

[EQ. 14] is modified to [EQ. 16] by using [EQ. 15].

[EQ. 15]

$$\begin{aligned}a &= \frac{e^{-jkr_c(\tau)}}{r_c(\tau)}\cos\phi_c(\tau)\cos\theta_c(\tau) \\ b &= \frac{e^{-jkr_c(\tau)}}{r_c(\tau)}\cos\phi_c(\tau)\sin\theta_c(\tau) \\ c &= \frac{e^{-jkr_c(\tau)}}{r_c(\tau)}\sin\phi_c(\tau) \\ \tilde{a}_i &= \frac{e^{-jkr_i}}{r_i}\cos\phi_i\cos\theta_i \\ \tilde{b}_i &= \frac{e^{-jkr_i}}{r_i}\cos\phi_i\sin\theta_i \\ \tilde{c}_i &= \frac{e^{-jkr_i}}{r_i}\sin\phi_i\end{aligned}$$

[EQ. 16]

$$\begin{aligned}E = {} & \left(a\cdot S(\omega) - \sum_{i=1}^{I}\tilde{a}_i\cdot Q_i(\omega)\right)\times\left(a\cdot S(\omega) - \sum_{i=1}^{I}\tilde{a}_i\cdot Q_i(\omega)\right)^* + \\ & \left(b\cdot S(\omega) - \sum_{i=1}^{I}\tilde{b}_i\cdot Q_i(\omega)\right)\times\left(b\cdot S(\omega) - \sum_{i=1}^{I}\tilde{b}_i\cdot Q_i(\omega)\right)^* + \\ & \left(c\cdot S(\omega) - \sum_{i=1}^{I}\tilde{c}_i\cdot Q_i(\omega)\right)\times\left(c\cdot S(\omega) - \sum_{i=1}^{I}\tilde{c}_i\cdot Q_i(\omega)\right)^*\end{aligned}$$

-continued $$\begin{aligned}& = S(\omega)(a\cdot a^* + b\cdot b^* + c\cdot c^*)S(\omega)^* + \\ & \sum_{i=1}^{I}\sum_{i'=1}^{I} Q_i(\omega)\left(\tilde{a}_i\cdot\tilde{a}_{i'}^* + \tilde{b}_i\cdot\tilde{b}_{i'}^* + \tilde{c}_i\cdot\tilde{c}_{i'}\right)Q_{i'}(\omega)^* - \\ & \sum_{i=1}^{I} Q_i(\omega)\left(\tilde{a}_i\cdot a^* + \tilde{b}_i\cdot b^* + \tilde{c}_i\cdot c^*\right)S(\omega)^* - \\ & \sum_{i=1}^{I} S(\omega)\left(\tilde{a}_i^*\cdot a + \tilde{b}_i^*\cdot b + \tilde{c}_i^*\cdot c\right)Q_i(\omega)^* \\ & = S(\omega)\cdot h_0\cdot S(\omega)^* + Q(\omega)^T\cdot H\cdot Q(\omega)^* - Q(\omega)^T\cdot h\cdot S(\omega)^* - \\ & S(\omega)\cdot(h^*)^T\cdot Q(\omega)^*\end{aligned}$$

Where $$h_0 = a\cdot a^* + b\cdot b^* + c\cdot c^*$$

$$Q(\omega) = [\,Q_1(\omega)\quad Q_2(\omega)\quad Q_3(\omega)\,]^T$$

$$h = \begin{bmatrix}\tilde{a}_1\cdot a^* + \tilde{b}_1\cdot b^* + \tilde{c}_1\cdot c^* \\ \vdots \\ \tilde{a}_I\cdot a^* + \tilde{b}_I\cdot b^* + \tilde{c}_I\cdot c^*\end{bmatrix}$$

$$H = \begin{bmatrix}\tilde{a}_1\cdot\tilde{a}_1^* + \tilde{b}_1\cdot\tilde{b}_1^* + \tilde{c}_1\cdot\tilde{c}_1^* & \dots & \tilde{a}_1\cdot\tilde{a}_I^* + \tilde{b}_1\cdot\tilde{b}_I^* + \tilde{c}_1\cdot\tilde{c}_I^* \\ \vdots & \ddots & \vdots \\ \tilde{a}_I\cdot\tilde{a}_1^* + \tilde{b}_I\cdot\tilde{b}_1^* + \tilde{c}_I\cdot\tilde{c}_1^* & \dots & \tilde{a}_I\cdot\tilde{a}_I^* + \tilde{b}_I\cdot\tilde{b}_I^* + \tilde{c}_I\cdot\tilde{c}_I^*\end{bmatrix}$$

The frequency region sound image forming acoustic signal Q(ω) which makes the square error E minimum is determined by [EQ. 17] showing that E partially differentiated by Q(ω) is zero.

$$\frac{\partial E}{\partial Q(\omega)} = H\cdot Q(\omega)^* - h\cdot S(\omega)^* = 0 \quad \text{[EQ. 17]}$$

Therefore, [EQ. 18] is established.

$$Q(\omega)^* = H^{-1}\cdot h\cdot S(\omega)^* \quad \text{[EQ. 18]}$$

Then, the frequency region sound image forming acoustic signal Q(ω) which makes the square error E minimum is calculated from [EQ. 19].

$$Q(\omega) = \begin{bmatrix}Q_1(\omega) \\ Q_2(\omega) \\ Q_3(\omega)\end{bmatrix} = (H^{-1}\cdot h)^*\cdot S(\omega) \quad \text{[EQ. 19]}$$

FIG. 5 is a flowchart of the panning routine executed at STEP S43 of the three dimensional acoustic panning program. At first, CPU 23 fetches the loudspeaker arrangement information $(r_1, \theta_1, \phi_1), (r_2, \theta_2, \phi_2) \dots (r_I, \theta_I, \phi_I)$. (STEP S431)

Secondly, CPU 23 fetches the panning information consisting the directional information $I_{pd}=(\theta(\tau), \phi(\tau))$ input by the track ball 27 shown in FIG. 3(*a*), and the distance information $I_{pr}=r(\tau)$ input by the pan pod 28 shown in FIG. 3(*b*). (STEP S432)

Then, CPU 23 calculates the coefficients a, b, c, etc., by [EQ. 15]. (STEP S433)

CPU 23 calculates the matrix H and the matrix h by [EQ. 16]. (STEP S434)

Finally, CPU 23 terminates the routine after calculating the frequency region sound image forming acoustic signal Q (ω). (STEP S435)

At this moment, the condition to placement the sound image applying the acoustic signal radiated by two loudspeakers is considered.

The sound receiving point J is the origin of X-Y coordinate system, the left side loudspeaker SL is arranged at the position with distance d from the sound receiving point J and with angle 30 degrees from the left side of Y-axis, and the right side loudspeaker is arranged at the position with distance d from the sound receiving point J and with angle 30 degrees from the right side of Y-axis.

The sound source SS is positioned at the position with distance D from the sound receiving point J and with angle θ from Y-axis. Note, the angle θ is defined by zero when the sound source is positioned on Y axis, by positive value at the right side of Y axis, and by negative value at the left side of Y axis.

In the above case, the coefficient of [EQ. 15] is defined by [EQ. 20].

$$a = \frac{-\sin\theta}{D}e^{-jkD} \quad b = \frac{-\cos\theta}{D}e^{-jkD} \quad c = 0 \qquad \text{[EQ. 20]}$$

$$\tilde{a}_1 = \frac{1}{2d}e^{-jkd} \quad \tilde{b}_1 = \frac{-\sqrt{3}}{2d}e^{-jkd} \quad \tilde{c}_1 = 0$$

$$\tilde{a}_2 = \frac{-1}{2d}e^{-jkd} \quad \tilde{b}_2 = \frac{-\sqrt{3}}{2d}e^{-jkd} \quad \tilde{c}_2 = 0$$

Where $\tilde{a}_1$, $\tilde{b}_1$, $\tilde{c}_1$ are the coefficients concerning the left side loudspeaker SL $\tilde{a}_2$, $\tilde{b}_2$, $\tilde{c}_2$ are the coefficients concerning the right side loudspeaker SR And, [EQ. 16] is defined by [EQ. 21].

$$h = \begin{bmatrix} \frac{-\sin\theta}{2dD}e^{-jk(d-D)} + \frac{\sqrt{3}\cos\theta}{2dD}e^{-jk(d-D)} \\ \frac{\sin\theta}{2dD}e^{-jk(d-D)} + \frac{\sqrt{3}\cos\theta}{2dD}e^{-jk(d-D)} \end{bmatrix} \qquad \text{[EQ. 21]}$$

$$H = \frac{1}{d^2}\begin{bmatrix} 1 & \frac{1}{2} \\ \frac{1}{2} & 1 \end{bmatrix}$$

Therefore, the output of the left side loudspeaker SL $Q_1(\omega)$ and the output of the right side loudspeaker SR $Q_2(\omega)$ are determined by [EQ. 22].

$$\begin{bmatrix} Q_1(\omega) \\ Q_2(\omega) \end{bmatrix} = \begin{bmatrix} \frac{d}{D}\cos\{k(d-D)\}\left(-\sin\theta + \frac{1}{\sqrt{3}}\cos\theta\right)S(\omega) \\ \frac{d}{D}\cos\{k(d-D)\}\left(\sin\theta + \frac{1}{\sqrt{3}}\cos\theta\right)S(\omega) \end{bmatrix} \qquad \text{[EQ. 22]}$$

When d=D, the panning by [EQ. 22] is identical with the panning by the known tangent law panning, and by the vector base amplitude panning.

As mentioned above, the first embodiment of the three dimensional acoustic panning device can be applied to the case where d is not equal D, and recognized as the modification of the conventional tangent law panning or the conventional vector base amplitude panning.

The Second Embodiment

The second embodiment is the case where I=3 in the first embodiment, and makes it possible to pan the sound image in the trigonal pyramid whose ridge lines are lines to connect the sound receiving point with each of the three loudspeakers.

In this case, the sound image acoustic pressure vector V is denoted by [EQ. 23].

$$V = -\begin{bmatrix} \sum_{i=1}^{3}\frac{e^{-jkr_i}}{r_i}\cos\phi_i\cos\theta_i Q_i(\omega) \\ \sum_{i=1}^{3}\frac{e^{-jkr_i}}{r_i}\cos\phi_i\sin\theta_i Q_i(\omega) \\ \sum_{i=1}^{3}\frac{e^{-jkr_i}}{r_i}\sin\phi_i Q_i(\omega) \end{bmatrix} \qquad \text{[EQ. 23]}$$

Where $\theta_i$=azimuth of the loudspeaker S $P_i$ $\phi_i$=elevation angle of the loudspeaker S $P_i$ $r_i$=distance between the origin and the loudspeaker S $P_i$ The matrix H and the matrix h are denoted by [EQ. 24].

[EQ. 24]

$$h = \begin{bmatrix} \tilde{a}_1\cdot a^* + \tilde{b}_1\cdot b^* + \tilde{c}_1\cdot c^* \\ \tilde{a}_2\cdot b^* + \tilde{b}_2\cdot b^* + \tilde{c}_2\cdot c^* \\ \tilde{a}_3\cdot a^* + \tilde{b}_3\cdot b^* + \tilde{c}_3\cdot c^* \end{bmatrix}$$

$$H = \begin{bmatrix} \tilde{a}_1\cdot\tilde{a}_1^* + \tilde{b}_1\cdot\tilde{b}_1^* + \tilde{c}_1\cdot\tilde{c}_1^* & \tilde{a}_1\cdot\tilde{a}_2^* + \tilde{b}_1\cdot\tilde{b}_2^* + \tilde{c}_1\cdot\tilde{c}_2^* & \tilde{a}_1\cdot\tilde{a}_3^* + \tilde{b}_1\cdot\tilde{b}_3^* + \tilde{c}_1\cdot\tilde{c}_3^* \\ \tilde{a}_2\cdot\tilde{a}_1^* + \tilde{b}_2\cdot\tilde{b}_1^* + \tilde{c}_2\cdot\tilde{c}_1^* & \tilde{a}_2\cdot\tilde{a}_2^* + \tilde{b}_2\cdot\tilde{b}_2^* + \tilde{c}_2\cdot\tilde{c}_2^* & \tilde{a}_2\cdot\tilde{a}_3^* + \tilde{b}_2\cdot\tilde{b}_3^* + \tilde{c}_2\cdot\tilde{c}_3^* \\ \tilde{a}_3\cdot\tilde{a}_1^* + \tilde{b}_3\cdot\tilde{b}_1^* + \tilde{c}_3\cdot\tilde{c}_1^* & \tilde{a}_3\cdot\tilde{a}_2^* + \tilde{b}_3\cdot\tilde{b}_2^* + \tilde{c}_3\cdot\tilde{c}_2^* & \tilde{a}_3\cdot\tilde{a}_3^* + \tilde{b}_3\cdot\tilde{b}_3^* + \tilde{c}_3\cdot\tilde{c}_3^* \end{bmatrix}$$

Then, the time region sound image forming acoustic signal q(t) denoted by [EQ. 25] is determined by inverse Fourier converting the frequency region sound image forming acoustic signal Q(ω).

[EQ. 25]

$$q_i(t,\tau) = \sigma(r_i, r_c(\tau))\Phi_i(\theta_1,\theta_2,\theta_3,\phi_1,\phi_2,\phi_3,\theta_c(\tau),\phi_c(\tau))s\left(t - \frac{r_c(\tau) - r_i}{c}\right)$$

Where $$\sigma(r_i, r_c(\tau)) - \frac{r_i}{r_c(\tau)}$$

$$\Phi_1(\theta_1,\theta_2,\theta_3,\phi_1,\phi_2,\phi_3,\theta_c(\tau),\phi_c(\tau)) = \frac{N_1}{D}$$

$$\Phi_2(\theta_1,\theta_2,\theta_3,\phi_1,\phi_2,\phi_3,\theta_c(\tau),\phi_c(\tau)) = \frac{N_2}{D}$$

$$\Phi_3(\theta_1,\theta_2,\theta_3,\phi_1,\phi_2,\phi_3,\theta_c(\tau),\phi_c(\tau)) = \frac{N_3}{D}$$

$$N_1 = \cos\phi_2\sin\phi_3\sin(\theta_2 - \theta_c(\tau))\cos\phi_c(\tau) + \sin\phi_2\cos\phi_3\sin(\theta_c(\tau) - \theta_3)\cos\phi_c(\tau) + \cos\phi_2\cos\phi_3\sin(\theta_3 - \theta_2)\sin\phi_c(\tau)$$

$$N_2 = \cos\phi_3\sin\phi_1\sin(\theta_3 - \theta_c(\tau))\cos\phi_c(\tau) + \sin\phi_3\cos\phi_1\sin(\theta_c(\tau) - \theta_1)\cos\phi_c(\tau) + \cos\phi_3\cos\phi_1\sin(\theta_1 - \theta_3)\sin\phi_c(\tau)$$

-continued $$N_3 = \cos\phi_1 \sin\phi_2 \sin(\theta_1 - \theta_c(\tau))\cos\phi_c(\tau) + \sin\phi_1 \cos\phi_2 \sin(\theta_c(\tau) - \theta_2)\cos\phi_c(\tau) + \cos\phi_1 \cos\phi_2 \sin(\theta_2 - \theta_1)\sin\phi_c(\tau)$$

$$D = \sin\phi_1 \cos\phi_2 \cos\phi_3 \sin(\theta_3 - \theta_2) + \cos\phi_1 \sin\phi_2 \cos\phi_3 \sin(\theta_1 - \theta_3) + \cos\phi_1 \cos\theta_2 \sin\phi_3 \sin(\theta_2 - \theta_1)$$

As described above, the second embodiment makes it possible to pan the sound image within the trigonal pyramid whose ridge lines are lines to connect the sound receiving point with each of the three loudspeakers.

The Third Embodiment

The third embodiment enables to pan a sound image to an arbitrary position by applying more than 4 loudspeakers.

FIG. 8 is a perspective view to explain a case of panning a sound image from $C_1$ to $C_2$ by arranging eight loudspeakers $SP_1$-$SP_8$, and the sound image is panned from an initial position $C_1$ located in the trigonal pyramid whose ridge lines are lines to connect the sound receiving point G with each of the three loudspeakers $SP_2$, $SP_3$ and $SP_4$, to the terminal position $C_2$ located in the trigonal pyramid whose ridge lines are lines to connect the sound receiving point G with each of the three loudspeakers $SP_5$, $SP_6$ and $SP_7$.

Because an intersecting point of the trajectory of the sound image with a surface of the trigonal pyramid can be preliminary calculated, it becomes possible to pan a sound image to an arbitrary position by applying the second embodiment to each of trigonal pyramids.

The Forth Embodiment

The above embodiments make it possible to pan one sound source, but the present invention makes it possible to simultaneously pan a plurality of sound sources each of which keeps a constant relative position each other.

When there are M peaces of sound sources, the sound source acoustic pressure vector R generated by the sound source acoustic signals radiated from the M peaces of sound sources at the sound receiving point G is denoted by [EQ. 26] when the position of m-th loudspeaker is denoted by $C_m(r_{cm}(\tau), \theta_{cm}(\tau), \phi_{cm}(\tau))$ $(1 \leqq m \leqq M)$.

$$R = \begin{bmatrix} \sum_{m=1}^{M} R_{xm} \\ \sum_{m=1}^{M} R_{ym} \\ \sum_{m=1}^{M} R_{zm} \end{bmatrix} = -\begin{bmatrix} \sum_{m=1}^{M} \frac{e^{-jkr_{cm}(\tau)}}{r_{cm}(\tau)} \cos\phi_{cm}(\tau)\cos\theta_{cm}(\tau) S_m(\omega) \\ \sum_{m=1}^{M} \frac{e^{-jkr_{cm}(\tau)}}{r_{cm}(\tau)} \cos\phi_{cm}(\tau)\sin\theta_{cm}(\tau) S_m(\omega) \\ \sum_{m=1}^{M} \frac{e^{-jkr_{cm}(\tau)}}{r_{cm}(\tau)} \sin\phi_{cm}(\tau) S_m(\omega) \end{bmatrix} \quad \text{[EQ. 26]}$$

When the positions of three loudspeakers $SP_{mi}$ (i=1, 2, 3) which generates the acoustic filed where m-th sound source $C_m$ belongs to, are denoted $SP_{mi}(r_{mi}, \theta_{mi}, \phi_{mi})$, the sound image acoustic pressure vector $V_m$ generated by the frequency region sound image forming acoustic signal $Q_{mi}(\omega)$ radiated from the loudspeaker $SP_{mi}$, and V being overlapped with $V_m$, are denoted by [EQ. 27].

$$V_m = -\begin{bmatrix} \sum_{i=1}^{3} \frac{e^{-jkr_{mi}}}{r_{mi}} \cos\phi_{mi}\cos\theta_{mi} Q_{mi}(\omega) \\ \sum_{i=1}^{3} \frac{e^{-jkr_{mi}}}{r_{mi}} \cos\phi_{mi}\sin\theta_{mi} Q_{mi}(\omega) \\ \sum_{i=1}^{3} \frac{e^{-jkr_{mi}}}{r_{mi}} \sin\phi_{mi} Q_{mi}(\omega) \end{bmatrix} \quad \text{[EQ. 27]}$$

$$V = \sum_{m=1}^{M} V_m$$

Therefore, it becomes possible to simultaneously pan a plurality of sound sources each of which keeps a constant relative position each other by applying [EQ. 25] and [EQ. 26] instead of [EQ. 10] and [EQ. 22].

The Fifth Embodiment

The fifth embodiment is the three-dimensional acoustic panning device according to the present invention having devices necessary to product radio programs or TV programs, and include a panning information storage means 123 to store the panning information $I_p$, and a recording/editing means 131 to record and edit the sound image forming acoustic signal q(t).

The panning information storage means 123 works to store the panning information $I_p$ which includes the operation information of track ball 27 and pan pod 28, and makes it possible to repeat the same panning operation to a plurality of the sound sources.

The recording/editing means 131 works to record a plurality of the sound image forming acoustic signals q(t)'s and overlap them, and make it possible to generate the sound image forming acoustic signal when a plurality of the sound sources are panned respectively.

Now, the case where N groups of sound source groups each of which contains $M_n$ peaces of sound sources are panned by a unique panning operation respectively is considered.

When the position of the $m_n$-th sound source belonging to n-th sound source group is denoted by $C_{mn}(r_{cmn}, \theta_{cmn}(\tau), \phi_{cmn}(\tau))$, the sound source acoustic pressure vector $R_n$ at the sound receiving point G formed by the sound source acoustic signals radiated from $M_n$ peaces of sound sources, and the sound source acoustic pressure vector R at the sound receiving point formed by the sound source acoustic signals radiated $M_1+M_2+\ldots+M_N$ peaces of sound sources are denoted by [EQ. 28].

[EQ. 28]

$$R_n = \begin{bmatrix} \sum_{mn=1}^{M_n} R_{xmn} \\ \sum_{mn=1}^{M_n} R_{ymn} \\ \sum_{mn=1}^{M_n} R_{zmn} \end{bmatrix} = -\begin{bmatrix} \sum_{m_n=1}^{M_n} \frac{e^{-jkr_{cmn}(\tau)}}{r_{cmn}} \cos\phi_{cmn}(\tau)\cos\theta_{cmn}(\tau) S_{mn}(\omega) \\ \sum_{m_n=1}^{M_n} \frac{e^{-jkr_{cmn}(\tau)}}{r_{cmn}} \cos\phi_{cmn}(\tau)\sin\theta_{cmn}(\tau) S_{mn}(\omega) \\ \sum_{m_n=1}^{M} \frac{e^{-jkr_{cmn}}}{r_{cmn}} \sin\phi_{cmn}(\tau) S_{mn}(\omega) \end{bmatrix}$$

$$R = \sum_{n=1}^{N} R_n$$

When the positions of three loudspeakers $SP_{mni}$ (i=1, 2, 3) which generates the acoustic filed where $m_n$-th sound source $C_{mn}$ in n-th sound source group belongs to, are denoted $SP_{mni}$ ($r_{mni}$, $\theta_{mni}$, $\phi_{mni}$), the sound image acoustic pressure vector $V_{mn}$ generated by the frequency region sound image forming acoustic signal $Q_{mni}(\omega)$ radiated from the loudspeaker $SP_{mni}$, $V_n$ being overlapped with $V_{mn}$, and V being overlapped with $V_n$ are denoted by [EQ. 29].

[EQ. 29]

$$V_{mn} = -\begin{bmatrix} \sum_{i=1}^{3} \frac{e^{-jkr_{mni}}}{r_{mni}} \cos\phi_{mni}\cos\theta_{mni} Q_{mni}(\omega) \\ \sum_{i=1}^{3} \frac{e^{-jkr_{mni}}}{r_{mni}} \cos\phi_{mni}\sin\theta_{mni} Q_{mni}(\omega) \\ \sum_{i=1}^{3} \frac{e^{-jkr_{mni}}}{r_{mni}} \sin\phi_{mni} Q_{mni}(\omega) \end{bmatrix}$$

$$V_n = \sum_{mn=1}^{Mn} V_{mn}$$

$$V = \sum_{n=1}^{N} V_n$$

Therefore, it becomes possible to simultaneously pan a plurality of sound sources by applying [EQ. 28] and [EQ. 29] instead of [EQ. 10] and [EQ. 22].

The Sixth Embodiment

The above mentioned embodiment is the case where the sound source acoustic signals are received at one sound receiving point, but the sixth embodiment is the case where the sound source acoustic signals are received at one sound receiving field F.

Then, the sixth embodiment applies [EQ. 30] as the square error E between the sound source acoustic pressure vector R and the sound image acoustic pressure vector V.

[EQ. 30]

$$E = \int_V \|R - V\| dV = S(\omega)\cdot h_o \cdot S(\omega)^* + Q(\omega)^T \cdot H \cdot Q(\omega)^* - Q(\omega)^T \cdot h \cdot S(\omega)^* - S(\omega)\cdot (h^*)^T \cdot Q(\omega)^*$$

ただし、$h_0 = \int_V (a\cdot a^* + b\cdot b^* + c\cdot c^*) dV$ $$h = \begin{bmatrix} \int_V (\tilde{a}_1 \cdot a^* + \tilde{b}_1 \cdot b^* + \tilde{c}_1 \cdot c^*) dV \\ \vdots \\ \int_V (\tilde{a}_M \cdot a^* + \tilde{b}_M \cdot b^* + \tilde{c}_M \cdot c^*) dV \end{bmatrix}$$

$$H = \begin{bmatrix} \int_V \begin{pmatrix} \tilde{a}_1 \cdot \tilde{a}_1^* + \tilde{b}_1 \cdot \\ \tilde{b}_1^* + \tilde{c}_1 \cdot \tilde{c}_1^* \end{pmatrix} dV & \cdots & \int_V \begin{pmatrix} \tilde{a}_1 \cdot \tilde{a}_M^* + \tilde{b}_1 \cdot \\ \tilde{b}_M^* + \tilde{c}_1 \cdot \tilde{c}_M^* \end{pmatrix} dV \\ \vdots & \ddots & \vdots \\ \int_V \begin{pmatrix} \tilde{a}_M \cdot \tilde{a}_1^* + \tilde{b}_M \cdot \\ \tilde{b}_1^* + \tilde{c}_M \cdot \tilde{c}_1^* \end{pmatrix} dV & \cdots & \int_V \begin{pmatrix} \tilde{a}_M \cdot \tilde{a}_M^* + \tilde{b}_M \cdot \\ \tilde{b}_M^* + \tilde{c}_M \cdot \tilde{c}_M^* \end{pmatrix} dV \end{bmatrix}$$

As explained above, it is possible to pan the sound sources in the sound receiving field F by using [EQ. 30] instead of [EQ. 14].

The Seventh Embodiment

A mixing machine is generally applied to produce one sound source by mixing a plurality of sound sources (for example, narration, background music, sound effect, etc.), and recently digitized.

Then, it is possible to install the three-dimensional acoustic panning device in a digital mixing machine.

FIG. 9 is a block diagram of the three-dimensional acoustic panning device 7 installed in the digital mixing machine, the processing unit 70 is configured by CPU and memory 701, hard-disc 702, interface (I/F) 703, and bus 704.

Display panel 761, operation panel 76 composed of keyboard 761 and mouse 763, mixing console 75, track ball 77 and pan pod 78 are connected to I/F 703.

Operation panel 76 controls and supervises the over all operation of digital mixing machine 7, mixing console 75 determines parameters to mix a plurality of acoustic signals stored in hard disc 702 (amplitude, delay time, equalizing curve, etc.), and track ball 77 and pan pod 78 determine the panning direction and the panning interval of the acoustic signals stored in hard disc 702.

A mixing engine and a three-dimensional acoustic panning engine are installed in CPU and memory 701.

The mixing engine may include a delay program to delay specified acoustic signals and an equalizing program to collect a frequency spectrum of specified acoustic signals.

The three-dimensional acoustic panning engine is the three-dimensional acoustic panning program according to the present invention.

When mixing a plurality of acoustic signals by applying the digital mixing machine, a mixing engineer delays and equalizes the specific acoustic signals by setting parameters on the mixing console 75, and stores the mixed acoustic signal and the setting parameters on the mixing console 75 in hard disc 702.

When panning specific sound sources by applying the digital mixing machine, the three-dimensional acoustic panning engine pans the positions of the specific sound sources according to the operation of track ball 77 and pan pod 78, and stores panned acoustic signal and the he operation of track ball 77 and pan pod 78 in hard disc 702.

According to the above mentioned digital mixing machine, it is easy to mix panned acoustic signals with other acoustic signals, and to pan mixed acoustic signals.

The above mentioned embodiments execute the panning operation to the frequency region before panning acoustic signal Fourier converted from time region before panning acoustic signal and convert the frequency region after panning acoustic signal to the time region after panning acoustic signal by the inverse Fourier conversion. It is possible, however, to execute the panning operation in the time region by configuring the Fourier conversion means, the down mixing means and the inverse Fourier conversion means with delay units and filters.

INDUSTRIAL APPLICABILITY

As explained above, the three-dimensional acoustic panning device according to the present invention has effect that it can simulate the three-dimensional panning of the sound source by a plurality of loudspeakers arranged at the predetermined positions.

EXPLANATION OF NUMERALS

Figure 1:
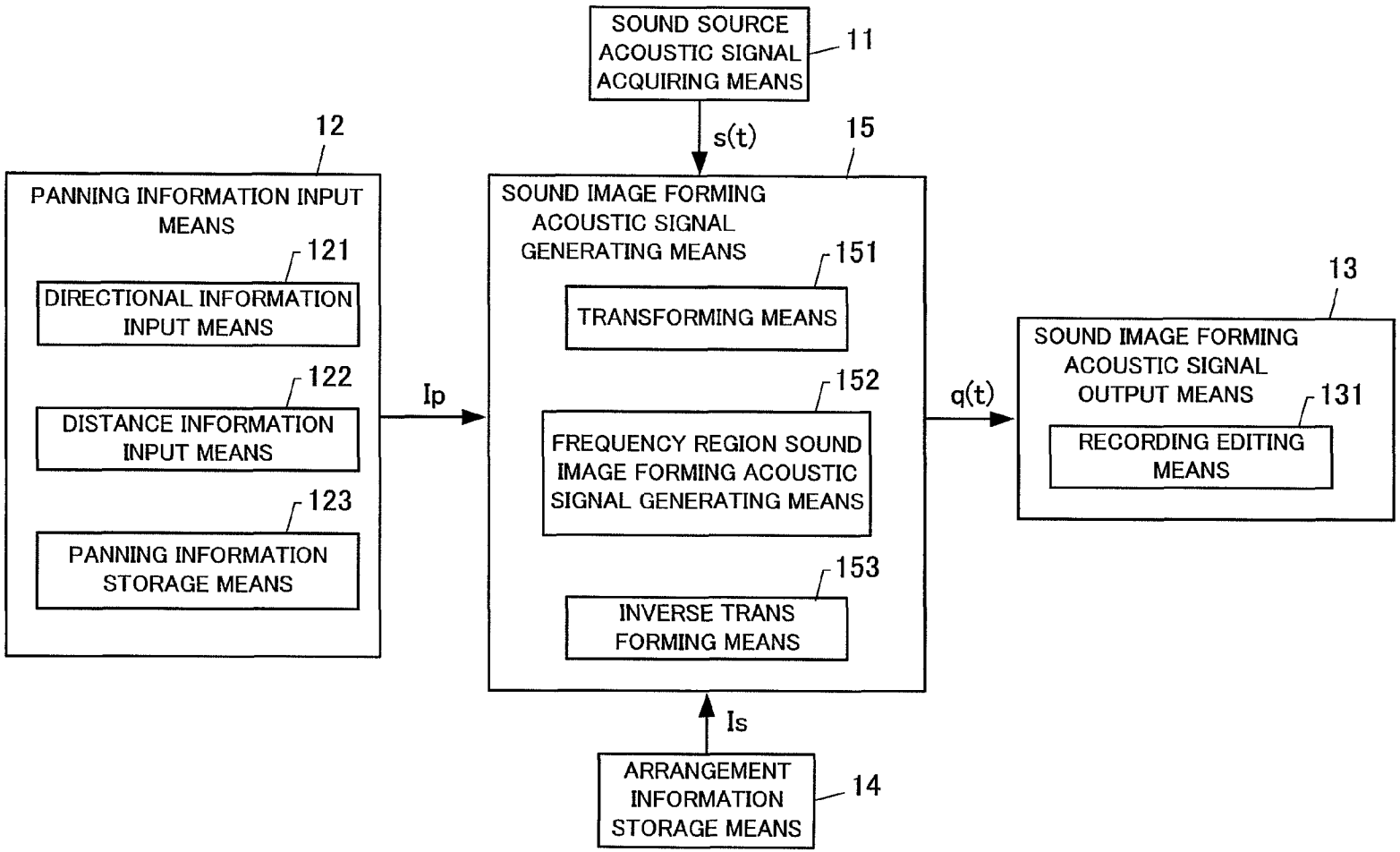
FIG. 1 is a block diagram of the three-dimensional acoustic panning device according to the present invention.
Figure 2:
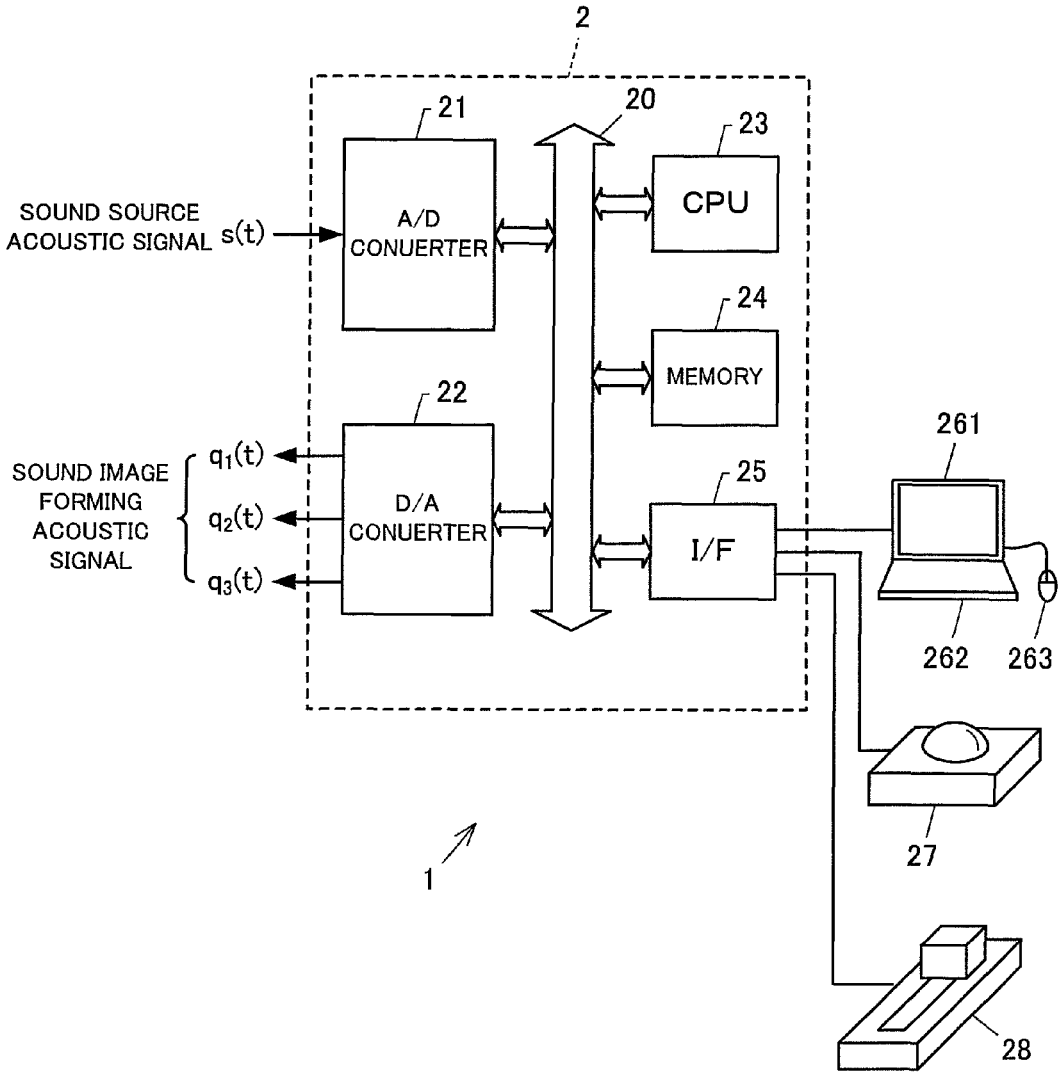
FIG. 2 is a block diagram showing the hardware architecture of the three-dimensional acoustic panning device according to the present invention.
Figure 3A:
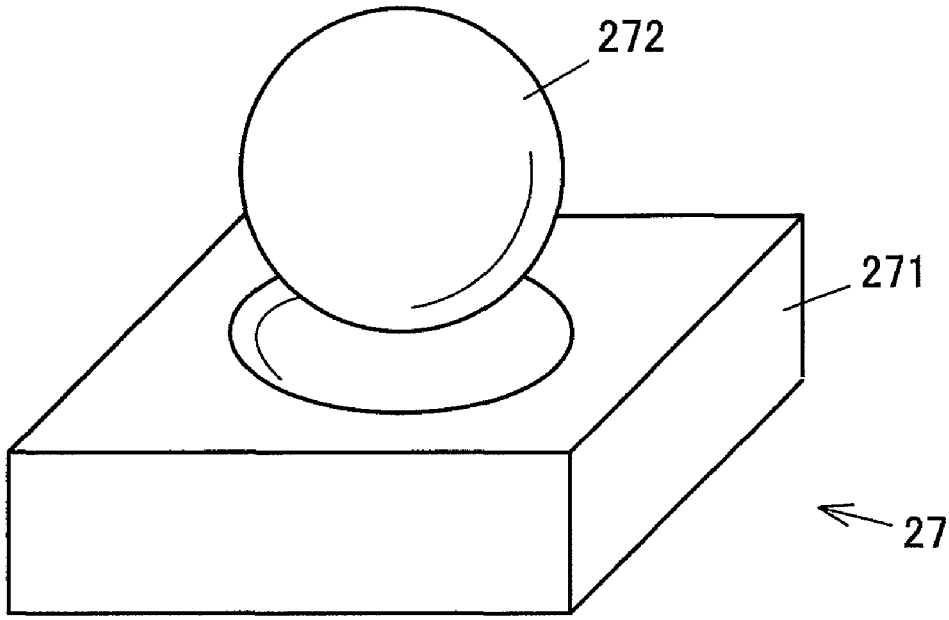
FIG. 3 is a perspective view of the track ball (a) and the pan pad (b) applied in the three-dimensional acoustic panning device according to the present invention.
Figure 3B:
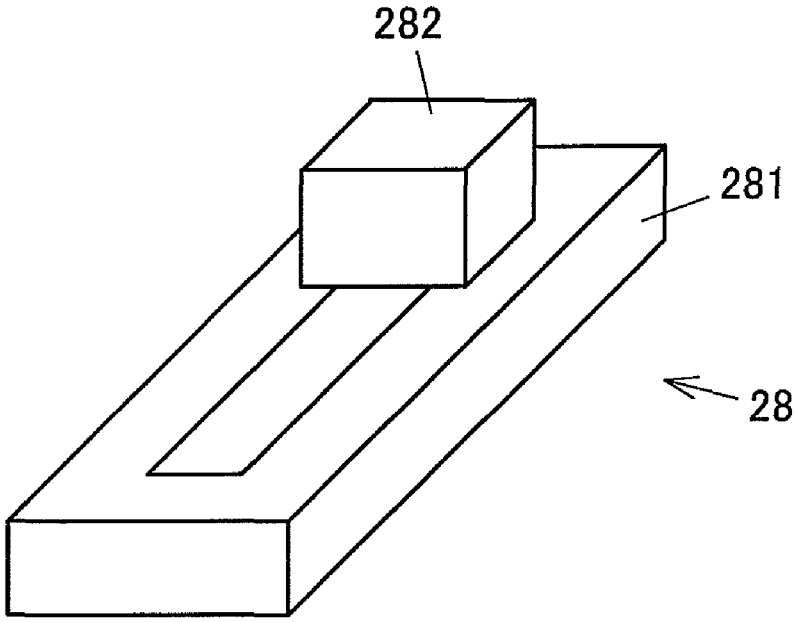
Figure 4:
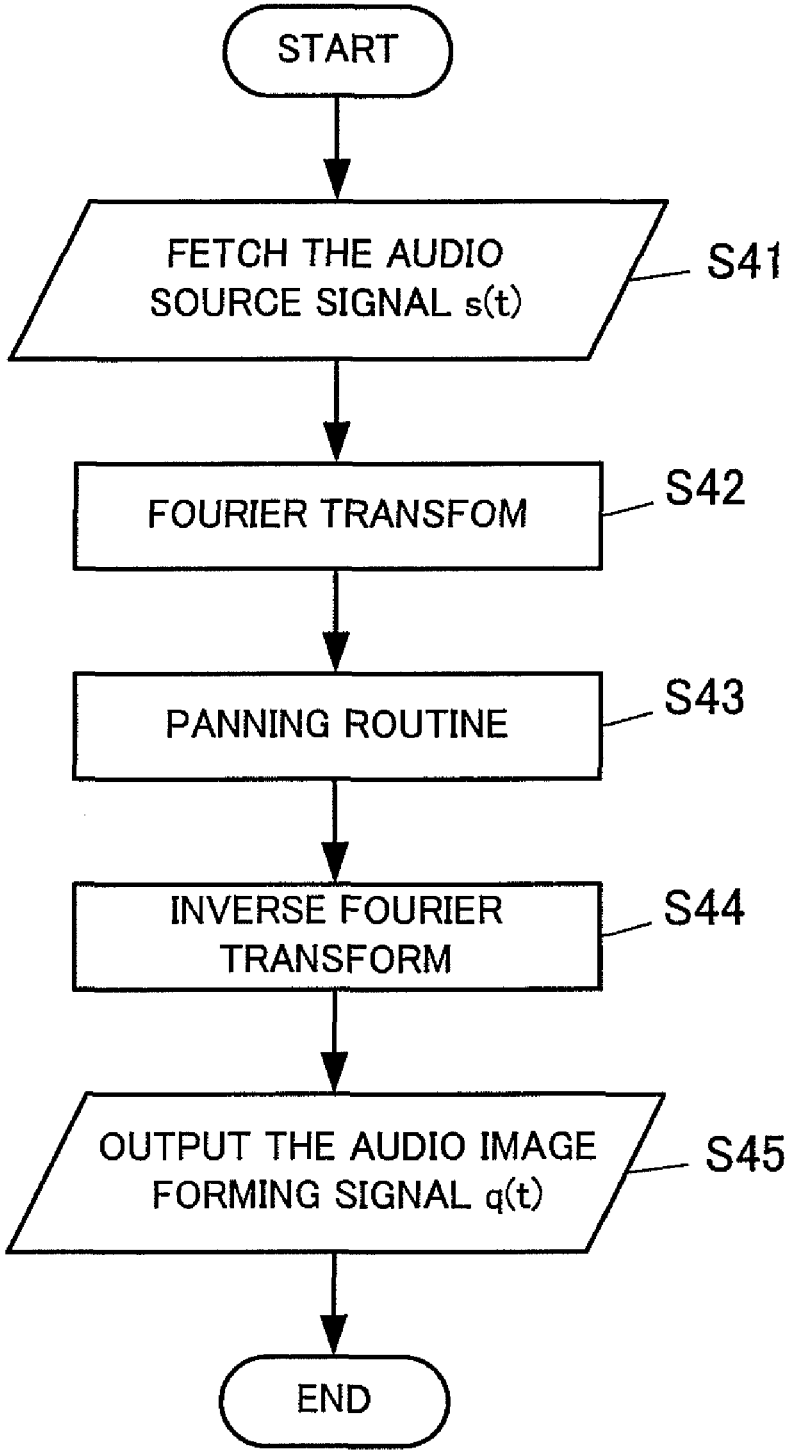
FIG. 4 is a flowchart of the three-dimensional acoustic panning program installed in the three-dimensional acoustic panning device according to the present invention.
Figure 5:
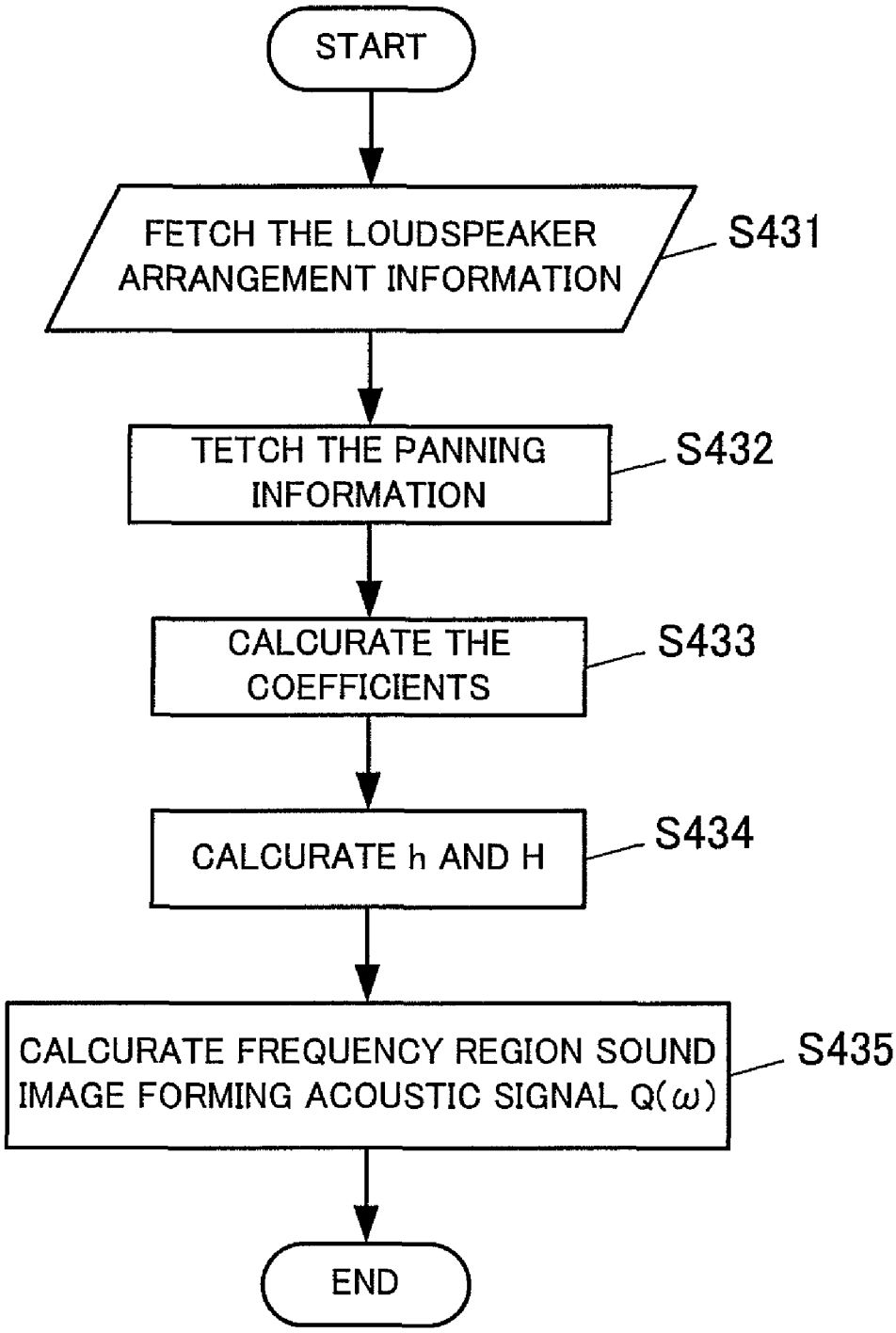
FIG. 5 is a flowchart of the panning routine.
Figure 6:
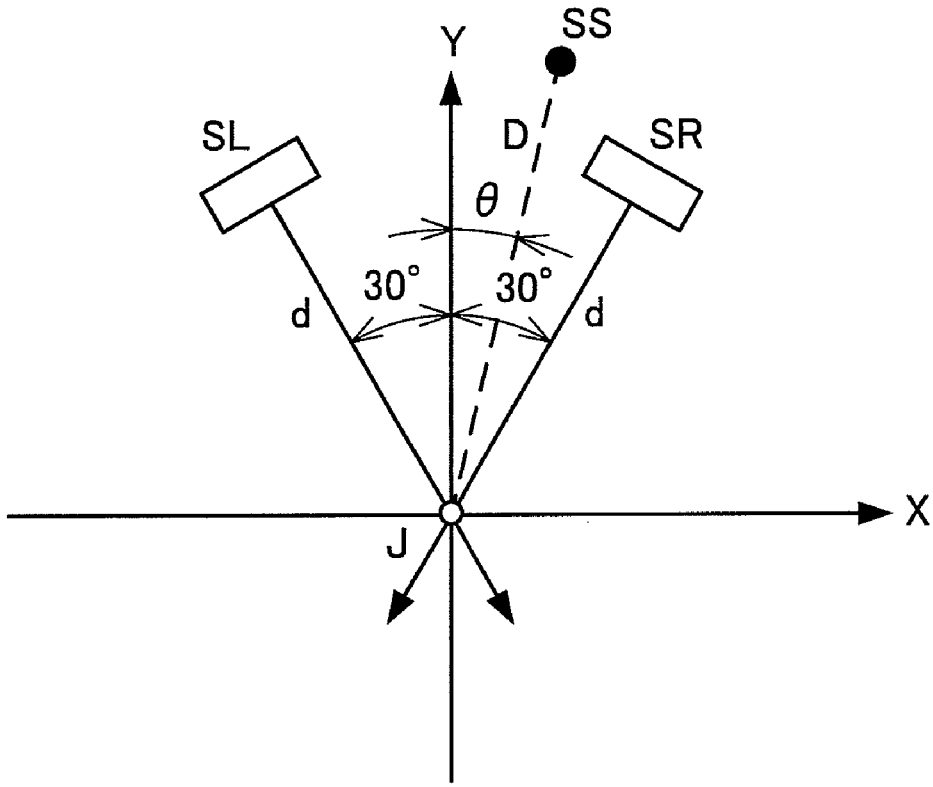
FIG. 6 is a layout drawing of two loudspeakers which form an acoustic field, FIG. 7 a layout drawing of three loudspeakers which form an acoustic field, FIG. 8 a layout drawing of eight loudspeakers which form an acoustic field.
Figure 7:
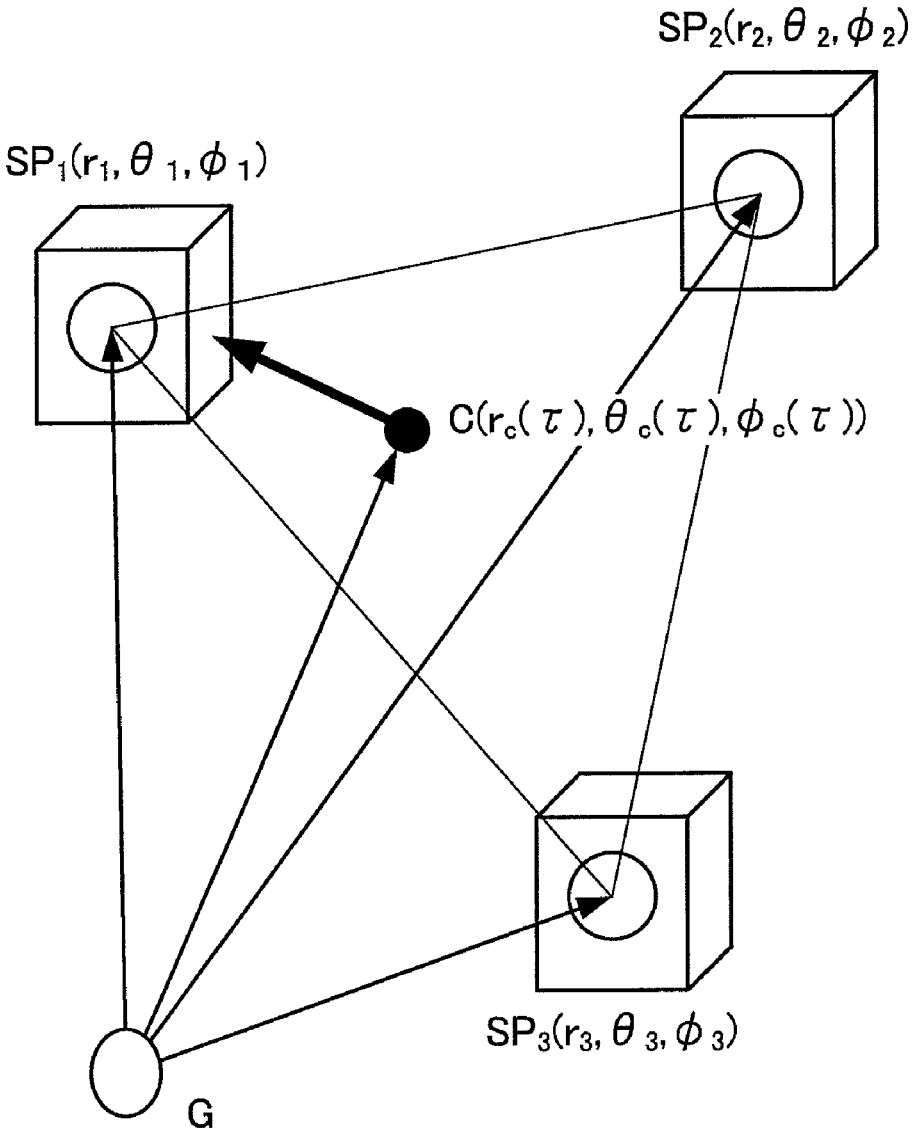
Figure 8:
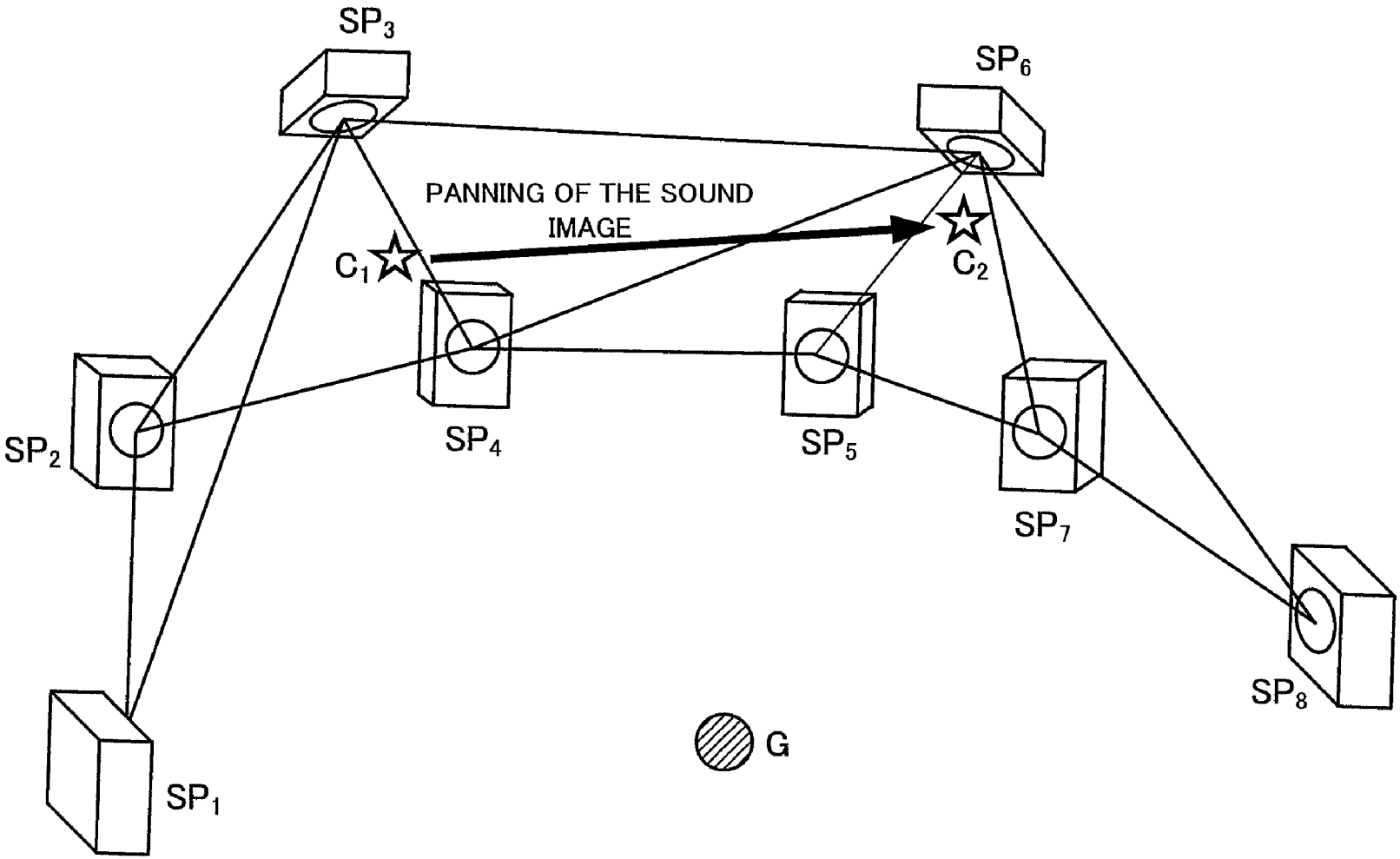
Figure 9:
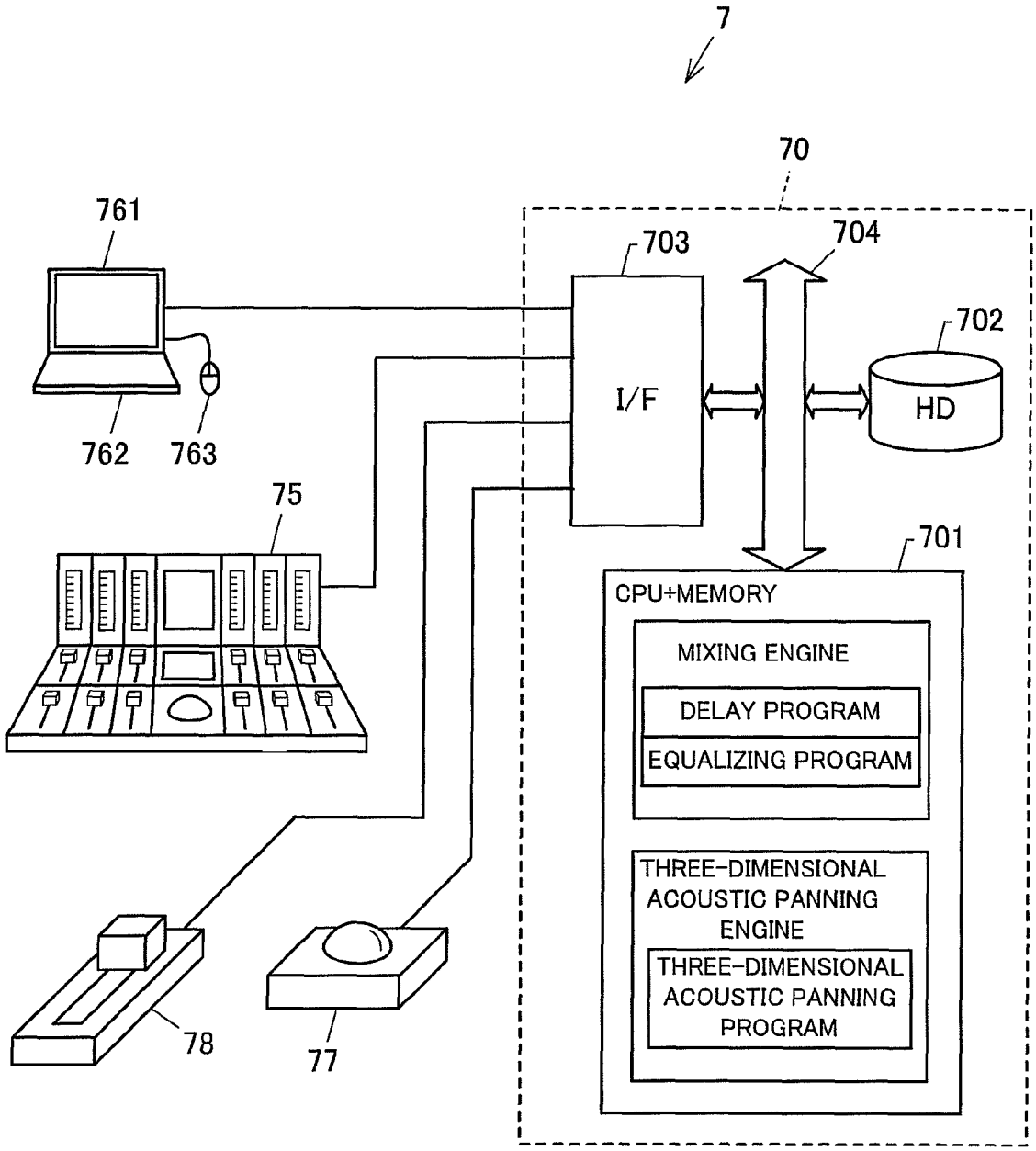
FIG. 9 is a block diagram of the three-dimensional acoustic panning device with a digital mixing function.

11: sound source acoustic signal acquiring means
12: panning information input means
13: sound image forming acoustic signal output means
14: arrangement information storing means
15: sound image forming acoustic signal generating means

What is claimed is:

1. A three-dimensional acoustic panning device comprising:

a sound source acoustic signal acquiring means for acquiring acoustic signals radiated from at least one sound source;

a sound image forming acoustic signal output means for outputting acoustic signals to form sound images;

an arrangement information storage means for storing an arrangement information of said sound image forming acoustic signal output means;

a panning information input means for inputting a panning information consisting of directions centering on the sound receiving point and distances between the sound receiving point and said sound source; and a sound image forming acoustic signal generating means for generating sound image forming acoustic signals which form sound images at the positions determined by said directions and said distances in said panning information in response to the change of said panning information based on said sound source acoustic signals and said arrangement information, and outputting said sound image forming signal to said image forming acoustic signal output means.

2. The three-dimensional acoustic panning device set forth in claim 1, wherein, said panning information input means comprising a directional information input means for inputting at least one set of directional information concerning the direction of said sound sources viewed from a sound receiving point and a distance information input means for inputting at least one set of distance information concerning the distance between said sound receiving point and said sound sources.

3. The three-dimensional acoustic panning device set forth in claim 2, wherein, said panning information input means having a panning information storage means for storing said panning information.

4. The three-dimensional acoustic panning device set forth in claim 1 wherein, said sound image forming acoustic signal output means having a recording/editing means for recording and editing said sound image forming acoustic signal.

5. The three-dimensional acoustic panning device set forth in anyone of claims 1-4, wherein, said sound image forming acoustic signal generating means comprising a transforming means for Fourier transforming said sound source acoustic signal to a frequency region sound source acoustic signal, a frequency region sound image forming acoustic signal generating means for generating a frequency region sound image forming acoustic signal using said frequency region sound source acoustic signal, said panning information, and said arrangement information, and an inverse transforming means for inverse Fourier transforming said frequency region sound image forming acoustic signal to said sound image forming acoustic signal which is a time region signal.

6. The three-dimensional acoustic panning device set forth in claim 5, wherein, said frequency region sound image forming acoustic signal generating means generates said sound image forming acoustic signal which forms a sound image acoustic physical quantity vector at the sound receiving point equal to the sound source acoustic physical quantity vector which is an acoustic physical quantity vector at the sound receiving point formed by panning the sound sources, which radiate the sound source acoustic signals, based on the panning information.

7. The three-dimensional acoustic panning device set forth in claim 5, wherein, said frequency region sound image forming acoustic signal generating means forms a sound image acoustic physical quantity vector at the sound signal receiving area equal to a sound source acoustic physical quantity vector which is an acoustic physical quantity vector at the sound signal receiving area formed by panning the sound sources which radiate the sound source acoustic signals based on the panning information.

8. The three-dimensional acoustic panning device set forth in anyone of claims 1-4, further comprising a mixing means for mixing the sound source acoustic signals acquired by said sound source acoustic signal acquiring means.

* * * * *